United States Patent [19]

Ditsch et al.

[11] Patent Number: 4,678,181

[45] Date of Patent: Jul. 7, 1987

[54] HAND DEVELOPMENT SYSTEM

[75] Inventors: John R. Ditsch, Tinley Park; Theodore G. Williams, Lyons; Luis H. Berrios, Chicago, all of Ill.

[73] Assignee: HDS, Inc., Tinley Park, Ill.

[21] Appl. No.: 904,851

[22] Filed: Sep. 8, 1986

Related U.S. Application Data

[63] Continuation-in-part of Ser. No. 755,708, Jul. 16, 1985, abandoned.

[51] Int. Cl.[4] ..... A63B 11/08

[52] U.S. Cl. ..... 272/68; 272/135

[58] Field of Search ..... 272/67, 68, 135–143; 128/26; 267/166, 169, 170, 174; 124/52

[56] References Cited

U.S. PATENT DOCUMENTS

| | | | |
|---|---|---|---|
| 2,634,976 | 4/1953 | Mock | 272/68 |
| 3,447,527 | 6/1969 | Cermak et al. | 124/52 |
| 3,738,651 | 6/1973 | Norman et al. | 272/67 |

*Primary Examiner*—Richard J. Apley
*Assistant Examiner*—S. Welsh
*Attorney, Agent, or Firm*—Wood, Dalton, Phillips, Mason & Rowe

[57] ABSTRACT

A hand development system to increase the strength and flexibility of the hands, fingers and forearms of a user. It includes a body adapted to be gripped by the hand of the user and a plurality of individually movable members operatively associated with the body. Each of the individually movable members, which may be in the form of keys, is adapted to be moved by one of the fingers of the user against resistance to movement provided by a component such as a spring. It includes a set of replaceable cartridges disposed in an interior compartment of the body for this purpose. With this construction, the cartridges each include at least one spring having a selected resistance to movement and each of the cartridges is positioned to resist movement of one of the keys.

31 Claims, 16 Drawing Figures

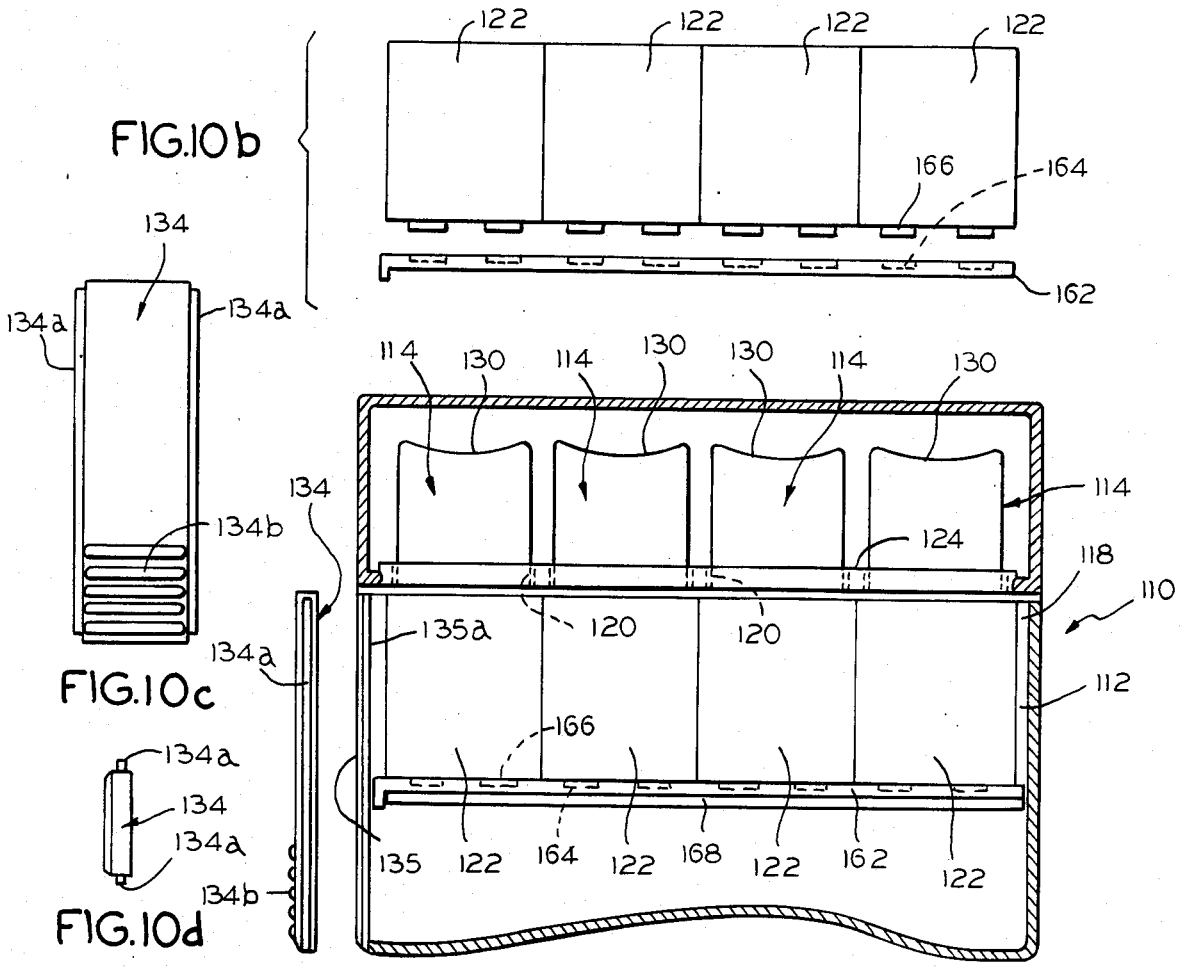
FIG.10b
FIG.10c
FIG.10d
FIG.10a
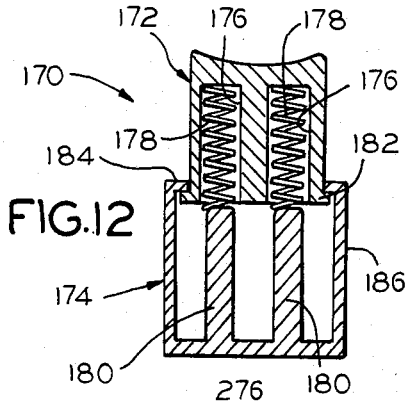
FIG.12
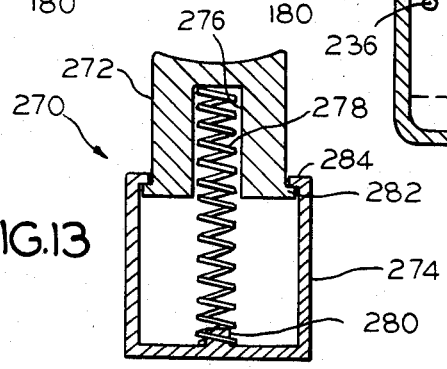
FIG.13
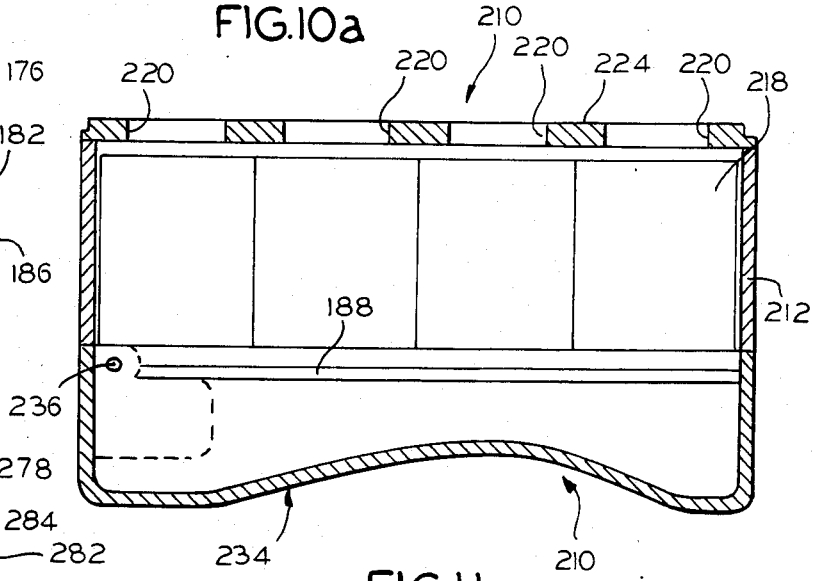
FIG.11

HAND DEVELOPMENT SYSTEM

This application is a continuation-in-part of application Ser. No. 755,708, filed 7/16/85, now abandoned.

FIELD OF THE INVENTION

This invention relates to an exercise device for hands, fingers and forearms of a user and, more particularly, to a hand development system for increasing strength and flexibility.

BACKGROUND OF THE INVENTION

In recent years, many individuals have focused attention on total body development through personally tailored diet and fitness programs. This is evident from the growth in fitness centers, retail sales of equipment for use at home and in physical fitness programs, and media attention to the growing public awareness of the need for proper diet and exercise and the benefits to be derived therefrom. Moreover, while more people are involved in fitness programs, they are also continuing with such programs throughout much of their lives.

Today, fitness centers and retail stores are well-equipped with free weights and body building machines. They also generally include apparatus and other facilities for aerobic conditioning ranging from stationary bicycles to running tracks. In addition, fitness centers and retail stores are well known for specialized programs of fitness training.

Despite the wide range of equipment and programs, exercise apparatus for development of the hands. fingers and forearms has been largely ignored. It is notable that, despite the many expensive devices commonly found in fitness centers and retail stores, there is usually no equipment whatsoever for exercise, entertainment and rehabilitation by increasing the strength and flexibility of the hands, fingers and forearms even though such development is important for properly utilizing the free weights and body building machines such as those commonly found in fitness centers. Even when provided, however, exercise apparatus for the hands and fingers has lagged in comparison to the development of other devices.

Specifically, hand exercise equipment has fallen into several different categories. One hand exerciser having a pair of handles joining together at corresponding ends by a coil spring has been among the most common devices. Another hand exerciser in the form of a continuous loop having a plurality of inwardly extending springs terminating in finger engaging rings has been among the most impractical devices. Further, hand exercise devices have been as undeveloped as a simple rubber ball adapted to be squeezed by the hand.

With all the drawbacks of the typical hand exercise devices, there has been no effort to provide any type of device for effectively exercising the individual fingers. Similarly, efforts to make it possible to select the resistance for each finger while exercising the hand have been non-existent. Finally, there has been little or no effort to provide protection for the hand and fingers curing exercise with such devices.

While overcoming problems of these types, it is also desirable to provide a construction which is asthetically pleasing, compact, and essentially self-contained.

The present invention is directed to overcoming the above stated problems and accomplishing the stated objectives.

SUMMARY OF THE INVENTION

Accordingly, the present invention is directed to a hand development system for increasing the strength and flexibility of the hands, fingers and forearms of a user. It includes a body adapted to be gripped by the hand of the user and a plurality of individually movable members operatively associated with the body. Each of the individually movable members, which may be in the form of keys, is adapted to be moved by one of the fingers of the user against resistance to movement provided by a component such as a spring. It may include a set of replaceable cartridges disposed in an interior compartment of the body for this purpose. With this construction, the cartridges each include at least one spring having a selected resistance to movement and each of the cartridges is positioned to resist movement of one of the keys.

In an exemplary embodiment, each of the keys is adapted to be depressed from a normal position by one of the fingers of the user. The spring-loaded cartridges are positioned relative to the keys to resist depression of the keys to return the keys to the normal position after depression. In this connection, the normal position is an outwardly extending position relative to the body of the hand development system.

More specifically, the body is preferably rectangular in shape and includes a top edge having a plurality of openings for the keys disposed in longitudinally aligned relationship. The keys normally extend above the top edge of the body and are adapted to be depressed to the top edge during use. In addition, the openings and the keys are each preferably rectangular in shape, and a component are provided for guiding the keys for non-binding sliding movement during depression thereof. Still more particularly, the hand development system may include two sets of spring-loaded cartridges adapted to be disposed in the interior compartment of the body. The springs in the two sets of cartridges have different resistance characteristics, i.e., resistance to movement when disposed beneath one of the keys when the user attempts to depress the key with a finger thereon. As a result, the user can select one or more of the cartridges from the first set and one or more of the cartridges from the second set to vary the resistance for different fingers.

In the preferred embodiment, the keys each include a concave finger engaging surface on the outer end thereof. Similarly, the body includes a concave hand engaging surface on the bottom thereof. Moreover, the finger engaging surfaces and the hand engaging surface are preferably padded.

Other objects, advantages and features will become apparent from the following specification taken in conjunction with the accompanying drawings.

BRIEF DESCRIPTION OF THE DRAWINGS

FIG. 10*a* is a cross-sectional view of another embodiment of hand development system in accordance with the present invention;

FIG. 10*b* is a front elevational view of a cartridge carrier and cartridges for the hand development system of FIG. 10*a;*

Figure 1:
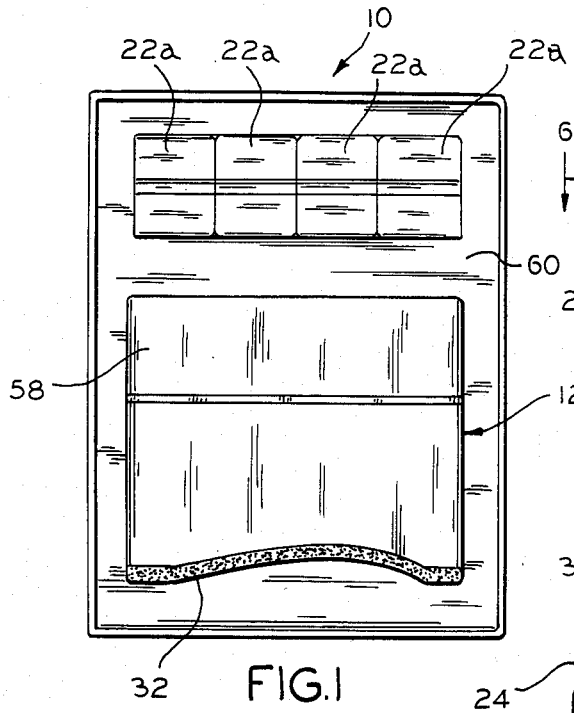
FIG. 1 is a front elevational view of a packaged hand development system in accordance with the present invention.

FIG . 10*c* is a front elevational view of a slidable door for the hand development system of 10*a;*

FIG. 10*d* is a top plan view of the the slidable door for the hand development system of 10*a;*

FIG. 11 is a cross-sectional view of still another embodiment of hand development system in accordance with the present invention;

FIG. 12 is a cross-sectional view of a key and cartridge for the hand development system of FIG . 11; and FIG. 13 is a cross-sectional view of another embodiment of key and cartridge for the hand development system of FIG. 11.

DETAILED DESCRIPTION OF THE PREFERRED EMBODIMENTS

An exemplary embodiment of a hand development system according to the invention is illustrated in FIGS. 1 through 9. The system 10 includes a body 12 adapted to be gripped by the hand of a user. It also comprises means for exercising the fingers of the user including a plurality of individually movable members or keys 14 together with means for resisting movement of the keys 14 such as a spring or springs 16 operatively associated with each of the keys, as will be described in detail hereinafter. The system 10 further includes an interior compartment 18 in the body 12 having a plurality of openings 20 adapted to receive the keys 14. In this manner, the means for exercising the fingers of the user is operatively associated with the body 12.

Figure 8:
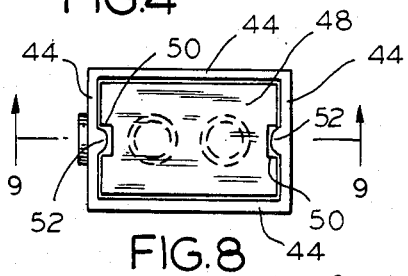
FIG. 8 is a top plan view of a cartridge for the hand development system.
Figure 7:
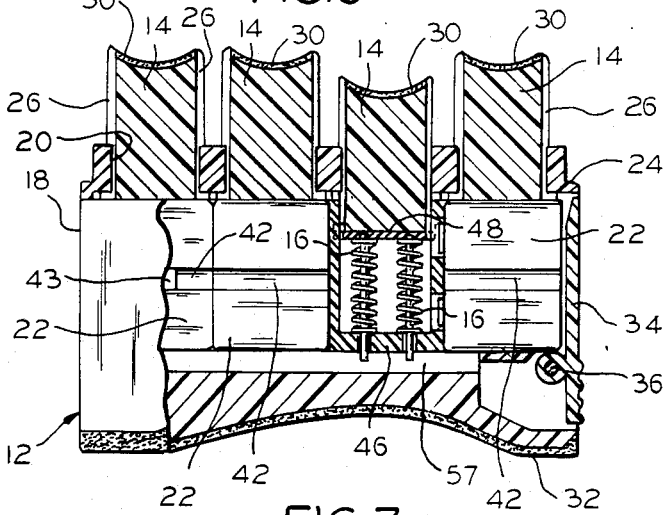
FIG. 7 is a cross-sectional view of the hand development system taken along the line 7—7 of FIG. 6.
Figure 9:
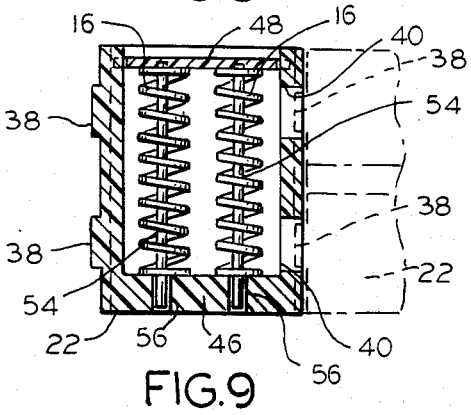
FIG. 9 is a cross-sectional view of the cartridge taken on the line 9—9 of FIG. 8.

Referring to FIGS. 7 through 9, each of the keys 14 is adapted to be depressed from a normal position by one of the fingers of the user. The spring or springs 16 are positioned to resist depression of the keys 14 and are adapted to return the keys 14 to the normal position after depression. Moreover, in the preferred embodiment, the spring or springs 16 are contained in a cartridge 22 for each of the keys 14.

As illustrated in FIG. 7, the opening 20 are in direct communication with the interior compartment 18 of the body 12, and one of the keys 14 is disposed in each of the openings 20 and normally extends outwardly therefrom, and in addition, the spring or springs 16 are disposed directly below the keys 14 to maintain the keys in the normally outwardly extending position.

As will be appreciated by referring to the drawings, the body 12 is generally rectangular in shape and the openings 20 are provided along a top edge 24 thereof. The openings 20 are disposed in longitudinally aligned relationship (see FIG. 6) and the keys 14 normally extend above the top edge 24 of the body 12 to a finger engaging position, as shown. With this arrangement, the keys 14 are adapted to be depressed to the top edge 24 of the body 12 by the fingers of the user.

Figure 6:
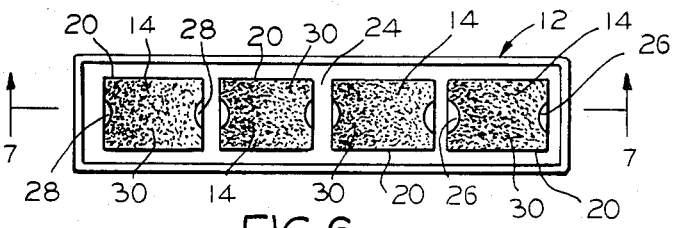
FIG. 6 is a top plan view of the hand development system taken along the line 6—6 of FIG. 2.

As best shown in FIG. 6, the openings 20 are generally rectangular in shape. The keys 14 similarly are each generally rectangular in shape and sized for sliding movement relative to the corresponding one of the openings. In addition, the interior compartment 18 is also preferably generally rectangular in shape.

Figure 5:
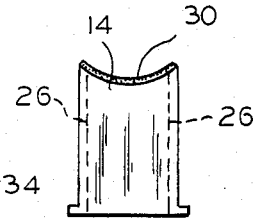
FIG. 5 is a front elevational view of a key for the hand development system of FIG. 1.

Referring in particular to FIGS. 5 through 7, the system 10 includes means for guiding the keys 14 for nonbinding movement during depression by the fingers of the user. The guiding means preferably comprises a pair of longitudinally opposed grooves 26 in either the keys 14 or openings 20 and a pair of complementarily shaped and longitudinally spaced ribs 28 on the other of the keys 14 and openings 20 with the ribs 28 being disposed in the grooves 26 to restrict the keys 14 to axial sliding movement relative to the openings 20. As will be seen, in tne preferred embodiment, the grooves 26 are provided in the keys 14 and the ribs 28 are provided in the openings 20.

Figure 3:
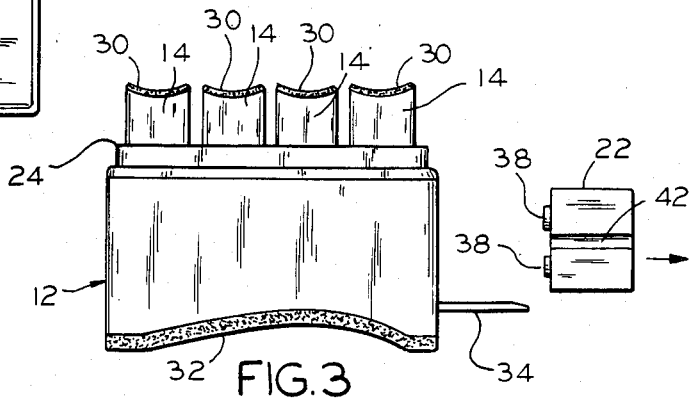
FIG. 3 is a plan view similar to FIG. 2 with a cartridge removed.
Figure 4:
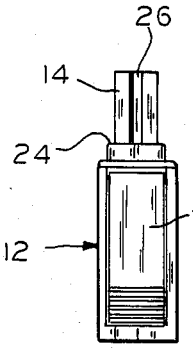
FIG. 4 is an end elevational view taken along the line 4—4 of FIG. 2.

Referring to FIG. 3, the keys 14 each include a concave finger engaging surface 30 on the outer end thereof. It will also be seen that the body 12 includes a concave hand engaging surface 32 on the bottom thereof adapted to be gripped between the thumb and first finger of the hand of the user. Moreover, the finger engaging surfaces 30 and the hand engaging surface 32 are preferably padded.

As shown in FIG. 7, the system 10 includes means for providing access to the interior compartment 18. The access means, which is preferably a door 34 pivotable about a pin 36, in independent from the openings 20 ror the keys 14 and spaced therefrom. As shown, the pivotable door 34 normally maintains the interior compartment I8 substantially entirely enclosed.

As discussed above, the system 10 includes a set of spring-loaded cartridges 22 disposed in the interior compartment 18. The springs 16 are provided if the cartridges 22 and have a selected resistance to depression of the keys 14 with each of the cartridges 22 being positioned to resist depression of one of the keys 14. As will be appreciated by referring to FIG. 7, the cartridges 22 are removable from the interior compartment 18 through the pivotable door 34.

As shown in FIG. 1, the system 10 may advantageously include a second set of spring-loaded cartridges 22*a* adapted to be disposed in the interior compartment 18. The springs (not shown) in the second set of cartridges 22*a* preferably have a selected resistance i.e., spring constant, different from the resistance of the first set of cartridges 22. As a result, the second set of cartridges 22*a* are such that one or more of such cartridges can be utilized in place of one or more of the cartridges from the first set of cartridges 22.

As will be appreciated by referring to FIGS. 8 and 9, the cartridges 22 (and 22*a*) are generally rectangular in shape and sized for sliding insertion into the interior compartment 18. The cartridges 22 each include means for interengagement with the next adjacent of the cartridges such as at least one lug 38 on one end of the cartridges and at least one hole 40 on the other end of the cartridges Where the lugs 38 and holes 40 are positioned such that the lug 38 of one of the cartridges engages with the hole of the next adjacent of the cartridges as shown in FIG. 9. In the preferred embodiment, the cartridges 22 each include a pair of lugs 38 and a corresponding pair of holes 40 to assure properly aligned interengagement of the cartridges 22 within the interior compartment 18.

As will be appreciated by referring to FIG. 7, the system 10 includes means for guiding the cartridges 22 (and 22*a*) during insertion of the cartridges into the interior compartment 18. In articular, the guiding means includes at least one longitudinally extending groove 42 in one of the interior compartment 18 and cartridges 22 (and 22*a*) and at least one complementarily shaped rib 43 on the other of the interior compartment 18 and cartridges 22 (and 22*a*) with the rib 43 being disposed in the groove 42 to maintain the cartridges 22 (and 22*a*) in position relative to the keys 14. In the preferred embodiment, the groove 42 is provided in the cartridges 22 (and 22*a*) and the rib 43 is provided in the interior compartment 18.

Referring to FIGS. 8 and 9, the cartridges 22 (and 22*a*) each include a plurality of side walls 44, a bottom wall 46, and a movable top wall 48 to be positioned adjacent the corresponding one of the keys 14. Moreover. the cartridges 22 (and 22*a*) each include at least one spring 16 extending between the top and bottom walls 48 and 46 together with means for guiding the top wall 48 for nonbinding axial movement relative to the side walls 44.

As shown, the guiding means includes a pair of longitudinally opposed grooves 50 in one of the top wall 48 and opposing side walls 44 and a pair of complementarily shaped and longitudinally spaced ribs 52 on the other of the top wall 48 and opposing side walls 44 with the ribs 52 being disposed in the grooves 50 to restrict the top wall 48 to axial sliding movement relative to the cartridge 22 (and 22*a*). In the preferred embodiment, the grooves 50 are provided in the top wall 48 and the ribs 52 are provided on the side walls 44.

Still referring to FIG. 9, the guiding means also preferably includes a pair of pins 54 extending downwardly from the top wall 48. The bottom wall 46 has a corresponding pair of holes 56 adapted to receive the pins 54 in axial sliding fashion, and the interior compartment includes a groove 57 aligned with the holes 56 in the cartridges 22 (and 22*a*) to receive the pins 54, as well. With the grooves 50 and ribs 52 and the pins 54 in the holes 56, the top wall 48 is well adapted for non-binding axial movement relative to the side walls 44.

Figure 2:
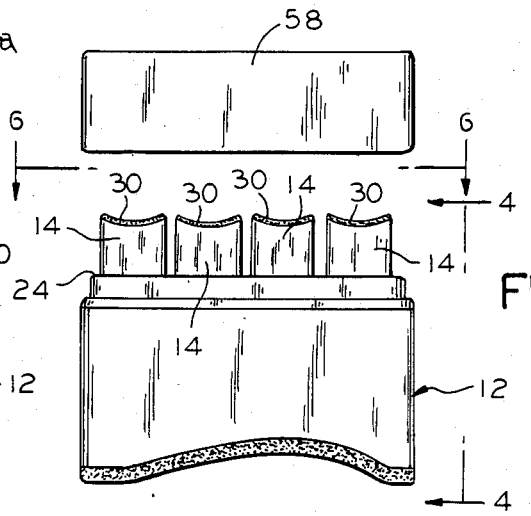
FIG. 2 is a front elevational view similar to FIG. 1 with a cap removed.

Referring to FIGS. 1 and 2, the system 10 preferably includes a cap 58 adapted to be disposed over the keys 14 in cooperation with the body 12 when the system 10 is not in use. This protects the keys 14 from damage and also presents an aesthetically pleasing design, as will be appreciated by referring to FIG. 1. Moreover, as shown in FIG. 1, the system 10 is well adapted for sale to the ultimate consumer in a compact and attractive package 60.

Referring to FIG. 10*a*, another embodiment of hand development system 110 according to the invention is illustrated. The system 110 includes a body 112 adapted to be gripped by the hand of a user. It also comprises means for exercising the fingers of the user including a plurality of individually movable members or keys 114 together with means for resisting movement of the keys 114 such as a spring or springs operatively associated with each of the keys, as will be described in detail hereinafter. The system 110 further includes an interior compartment 118 in the body 112 having a plurality of opening 120 adapted to receive the keys 114. In this manner, the means for exercising the fingers of the user is operatively associated with the body 112.

As with the earlier discussed embodiment, each of the keys 114 is adapted to be depressed from a normal position by one of the fingers of the user. Tne spring or springs (not shown) are positioned to resist depression of the keys 114 and are adapted to return the keys 114 to the normal position after depression. Moreover, as in the earlier described embodiment, the spring or springs are contained in a cartridge 122 for each of the keys 114.

As will be appreciated by referring to FIG. 10*a*, the openings 120 are in direct communication with the interior compartment 118 of the body 112. It will also be appreciated that one of the keys 114 is disposed in each of the openings 120 and normally extends outwardly therefrom. In addition, because of the placing of the carttidges 122, the spring or springs are disposed directly below the keys 114 to maintain the keys in the normally outwardly extending position.

Once again, the body 112 is generally rectangular in shape and the openings 120 are provided along a top edge 124 thereof. The openings 120 are disposed in longitudinally aligned relationship and the keys 114 normally extend above the top edge 124 of the body 112 to a finger engaging position, as shown. With this arrangement, the keys 114 are adapted to be depressed to the top edge 124 of the body 112 by the fingers of the user.

As in the earlier described embodiment, the openings 120 are generally rectangular in shape. The keys 114 similarly are each generally rectangular in shape and sized for sliding movement relative to the corresponding one of the openings. In addition, the interior compartment 118 is also preferably generally rectangular in shape.

Similarly, the keys 114 again include a concave finger engaging surface 130 on the outer end thereof. It will also be seen that the body 112 again includes a concave hand engaging surface 132 on the bottom thereor adapted to be gripped between the thumb and first finger of the hand of the user. Moreover, the finger engaging surfaces 130 and the hand engaging surface 132 can again be padded, if desired.

As with the earlier described embodiment, the system 110 includes means for providing access to the interior compartment 118. However, in this embodiment, the access means is a slidable door 134 which is independent from the openings 120 for the keys 114 and spaced therefrom. As will be appreciated from FIG . 1O*a*, the slidable door 134 normally maintains the interior compartment 118 substantially entirely enclosed.

As will be seen by referring to FIGS. 10*c* and 10*d*, the slidable door 134 includes outwardly extending flanges 134*a* on opposite sides thereof. It also includes a textured thumb or finger engaging surface 134*b* to aid in removing and replacing the door on the end of the body 112, which has an opening 135 with opposing slots 135*a* adapted to receive the outwardly extending flanges 134*a* of the slidable door 134. With this construction, the slidable door 134 can easily be removed and replaced for purposes of removing and replacing the cartridges 122.

Referring to FIGS. 10*a* and 10*b*, it will be seen that another significant difference in this embodiment is the use of a removable cartridge carrier 162. The removable cartridge carrier 162 is provided with one, and preferably a pair, of holes 164 for each of the cartridges 122 adapted for receiving a corresponding lug or lugs 166 of each of the cartridges 122 in frictional interengagement fashion. As a result, the cartridges 122 can be loaded onto the removable cartridge carrier 162 prior-to insertion into the interior compartment 118.

Also, referring specifically to FIG. 10*a*, the interior compartment 118 includes a pair of longitudinally extending ribs, such as at 168, positioned such that the removable cartridge carrier 162 can slide thereupon into the interior compartment 118. The ribs and cartridge carrier thereafter maintain the cartridges 122 in position relative to the keys 114. When it is desired to replace the cartridges 122 with cartridges of different strength, the cartridge carrier 162 can be removed and one or more of the cartridges 122 can be removed and replaced before replacing the cartridge carrier 162 in the interior compartment 118.

Referring to FIG. 11, still another emoodiment of hand development system 210 according to the invention is illustrated. The system 210 is similar to the previously described embodiments in many details. Accordingly, only the differences in construction will be described.

As shown, the system 210 includes means for providing access to the interior compartment 218 but the access means in this embodiment, while a pivotable door 234 which is pivotable about a pin 236, operates so as to open the entire bottom portion of the body 210. This is done so as to accommodate the utilization of means for exercising the fingers of the user in the form of integral keys and cartridges 170 each comprised of a key portion 172 and a cartridge portion 174 (see FIG. 12) where the key portion 172 includes a pair of bores 176 carrying springs 178 therein and the cartridge portion 174 includes a corresponding pair of vertically extending posts 180 adapted for sliding insertion and movement within the bores 176 against the resistance of the springs 178. Also, as shown in FIG. 12, the key 172 includes a pair of outwardly extending flanges 182 cooperating with inwardly extending flanges 184 of the cartridge portion 174 to retain the key portion 172 in the cartridge portion 174.

As will be appreciated, the outwardly extending flanges 182 also serve to guide movement of the key portions 172 within the cartridge portions 174. This is done by means of cooperation of the outwardly extending flanges 182 with the parallel opposed side walls 186 of the cartridge portion 174. Of course, movement of the key portion 172 within the cartridge portion 174 is also guided by means of the vertically extending posts 180.

Referring once again to FIG. 11, it will be seen that the pivotable door 234 includes a pair of ribs such as 188 for supporting the integral keys and cartridges 170 within the interior compartment 218. It will, therefore, be seen that the pivotable door 234 can be swung open about the pin 236 to expose the bottom of the body 212, the selected integral keys and cartridges 170 can be dropped into position such that the key portions 172 extend through the openings 220 in the body 212 so as to extend above the top edge 224 thereof, and the pivotable door can be swung shut about the pin 236 to close the interior department 218 at which time the ribs 188 are in engagement with the bottom of the integral keys and cartridges 170 to support and maintain them in position.

Referring to FIG. 13, another embodiment of integral key and cartridge 270 is illustrated. It includes a key portion 272 and a cartridge 274 where the key portion 272 includes a single central bore 276 carrying a spring 278 which extends to an upstanding lug 280 in the bottom of the cartridge portion 274. As in the embodiments illustrated in FIG. 12, the key portion 272 includes outwardly extending flanges 282 adapted to cooperate with inwardly extending flanges 284 on the cartridge portion 274, and the outwardly extending flanges 282 cooperate with the opposed parallel side walls 286 for guiding movement of the key portion 272 in the cartridge portion 274.

While in the foregoing there have been set forth preferred embodiments of the invention, it is to be understood that the invention is only to be limited by the spirit and scope of the appended claims.

We claim:

1. A hand development system, comprising:

a body adapted to be gripped by the hand of a user, said body including a single interior compartment and a plurality of openings in communication with said single interior compartment, said openings being provided along a top edge of said body;

means for exercising the fingers of the user, said exercising means being operatively associated with said body and including a plurality of individually movable members each adapted to be moved by one of the fingers of the user, said exercising means also including means for resisting movement of said individially moveable members;

said individually moveable members each comprising a key adapted to be depressed from a normal position by one of the fingers of the use, one of said keys being disposed in each of said openings and normally extending outwardly therefrom, said body being generally rectangular in shape and said openings being disposed in longitudinally aligned relationship, said keys each being adapted for sliding movement relative to the corresponding one of said openings;

means for access to said single interior compartment of said body, said access means being independent of said openings for said keys and spaced therefrom, said access means normally maintaining said single interior compartment of said body substantially entirely enclosed;

said movement resisting means including a set of spring-loaded cartridges disposed in said single interior compartment, said cartridges each including at least one spring having a selected resistance to depression of said keys, said cartridges being removable from said single interior compartment through said access means;

said interior compartment of said body being generally rectangular in shape, said cartridges also being generally rectangular in shape, said cartridges being sized for sliding insertion into said interior compartment; and means for accurately positioning each of said cartridges within said single interior compartment for resisting movement of one of said keys.

2. The hand development system as defined by claim 1 wherein said keys normally extend above said top edge of said body, said keys being adapted to be depressed to said top edge of said body by the fingers of the user, said cartridges returning said keys to said normally extending position after depression thereof.

3. The hand development system as defined by claim 1 wherein said openings and said keys are also generally rectangular in shape and sized for relative sliding movement, and including means for guiding said keys for non-binding movement during depression by the fingers of the user.

4. The hand development system as defined by claim 3 wherein said key guiding means includes a pair of longitudinally opposed grooves in either each or said keys or each of said cartridges, said key guiding means also including a pair of complementarily shaped and longitudinally spaced ribs on the other of each of said keys or each of cartridges, said ribs being disposed in said grooves to restrict said keys to axial sliding movement relative to said cartridges.

5. The hand development system as defined by claim 1 wherein said keys each include a concave finger engaging surface on the outer end thereof, said body including a concave hand engaging surface on the bottom thereof, said finger engaging surfaces and said hand engaging surface being padded.

6. The hand development system as defined by claim 1 including a second set of spring-loaded cartridges adapted to be disposed in said interior compartment, said cartridges in said second set each including at least one spring having a selected resistance different from the resistance of said first set of cartridges, said second set of cartridges being such that one or more of said cartridges can be utilized in place of one or more of said cartridges from said first set of cartridges.

7. The hand development system as defined by claim 1 wherein said cartridges each include means for interengagement with the next adjacent of said cartridges, said interengagement means comprising said means for positioning each of said cartridges within said single interior compartment for resisting movement of one of said keys.

8. The hand development system as defined by claim 7 wherein said interengagement means includes at least one lug on one end of said cartridges and at least one hole on the other end of said cartridges, said lugs and holes being positioned such that said lug of one of said cartridges engages with said hole of the next adjacent of said cartridges, said lugs being disposed in said holes to maintain said cartridges in position relative to said keys.

9. The hand development system as defined by claim 1 including means for guiding said cartridges during insertion of said cartridges into said interior compartment, said cartridge guiding means comprising said means for positioning each of said cartridges within said single interior compartment for resisting movement of one of said keys.

10. The hand development system as defined by claim 9 wherein said cartridge guiding means includes at least one longitudinally extending groove in either said interior compartment or each of said cartridges, said cartridge guiding means also including at least one complementarily shaped rib on the other of said interior compartment or each of said cartridges, said rib being disposed in said groove to maintain said cartridges in position relative to said keys.

11. The hand development system as defined by claim 1 wherein said cartridges each include a plurality of side walls and a bottom wall, said cartridges being generally rectangular in shape, said cartridges also each including a movable top wall adjacent the corresponding one of said keys.

12. The hand development system as defined by claim 11 said cartridges each include at least one spring extending between said top and bottom walls, and means for guiding said top wall for non-binding axial movement relative to said side walls.

13. The hand development system as defined by claim 12 wherein said top wall guiding means includes a pair of longitudinally opposed grooves in either said top wall or said opposing side walls, said top wall guiding means also including a pair complementarily shaped and longitudinally spaced ribs on the other of said top wall or said opposing side walls, said ribs being disposed in said grooves to restrict said top wall to axial sliding movement relative to said opposing side walls.

14. The hand development system as defined by claim 11 wherein said top wall guiding means includes a pair of pins extending downwardly from said top wall, said bottom wall having a corresponding pair of holes adapted to receive said pins in axial sliding fashion.

15. The hand development system as defined by claim 1 wherein said access means includes a pivotable door at one end of said body, said door being movable between open and closed positions.

16. The hand development system as defined by claim 1 including a cap adapted to be disposed over said keys in cooperation with said body when said system is not in use.

17. The hand development system as defined by claim 1 wherein said single interior compartment includes a pair of longitudinally extending ribs, said carrridge positioning means including a removable cartridge carrier, said removable cartridge carrier and cartridges being sized for sliding insertion on said longitudinally extending ribs into said single interior compartment.

18. The hand development system as defined by claim 17 including at least one lug on either the bottom of each of said cartridges or the top of said removable cartridge carrier and at least one hole on the other of the bottom of each of said cartridges or the top of said removable cartridge carrier, said lugs being disposed in said holes to maintain said cartridges in position relative to said keys.

19. The hand development system as defined by claim 1 wherein said access means includes a slidable door at one end of said body, said door being movable between open and closed positions.

20. A hand development system, comprising:

a body adapted to be gripped by the hand of a user, said body including a single interior compartment and a plurality of openings in communication with said single interior compartment, said openings being provided along a top edge of said body;

means for exercising the fingers of tne user, said exercising means being operatively associated with said body and including a plurality of individually movable members each adapted to be moved by one of the fingers of the user, said exercising means also including means for resisting movement of said individually movable members;

said individually movable members each comprising a key adapted to be depressed from a normal position by one of the fingers of the user, one of said keys being disposed in each of said openings and normally extending outwardly therefrom, said body being generally rectangular in shape and said openings being disposed in longitudinally aligned relationship, said keys each being adapted for sliding movement relative to the corresponding one of said openings;

said movement resisting means including a set of spring-loaded cartridges disposed in said single interior compartment, said cartridges each including at least one spring having a selected resistance to depression of said keys, said keys being integrally associated with said cartridges and said springs; and means for access to said single interior compartment of said body, said access means being independent of said openings for said keys and spaced therefrom to accommodate removal of said integral keys and cartridges through a bottom edge of said body, said access means normally maintaining said single interior compartment of said body substantially entirely enclosed.

21. The hand development system as defined by claim 20 wherein said keys normally extend above said top edge of said body, said keys being adapted to be depressed to said top edge of said body by the fingers of the user, the cartridges returning said keys to said normally extended position after depression thereof.

22. The hand development system as defined by claim 20 wherein said body is generally rectangular in shape, said openings, keys, and single interior compartment also being generally rectangular in shape and sized for relative sliding movement of said integral keys and cartridges into said single interior compartment, and including means for guiding said keys for non-binding movement during depression by the fingers of the user.

23. The hand development system as defined by claim 22 wherein said key guiding means includes a pair of vertically extending posts in each of said cartridges and a corresponding pair of bores in each of said keys, said bores each carrying a spring and adapted to receive one of said posts in sliding relationship.

24. The hand development system as defined by claim 22 wherein said key guiding means includes a pair of outwardly extending flanges on each of said keys and a corresponding pair of side walls of each of said cartridges, said cartridges each having a centrally disposed lug in the bottom thereof and said keys each having a centrally disposed bore, and including a spring extending from said lug to the bottom of said bore.

25. The hand development system as defined by claim 20 wherein said access means includes a pivotable door on the bottom of said body, said door being movable between open and closed positions, said door including means for maintaining said cartridges in position within said single interior compartment.

26. The hand development system as defined by claim 25 wherein said position maintaining means includes a rib integrally associated with said door for supporting said cartridges within said single interior compartment.

27. The hand development system as defined by claim 20 wherein said keys each include a concave finger engaging surface on the outer end thereof, said body including a concave hand engaging surface on the bottom thereof, said finger engaging surfaces and said hand engaging surface being padded.

28. The hand development system as defined by claim 20 including a second set of integral keys and spring-loaded cartridges adapted to be disposed in said interior compartment, said keys and cartridges in said second set each including at least one spring have a selected resistance different from the resistance of said first set of keys and cartridges, said second set of keys and cartridges being such that one or more of said keys and cartridges can be utilized in place of one or more of said keys and cartridges from said first set of keys and cartridges.

29. The hand development system as defined by claim 20 wherein said cartridges each include a plurality of side walls and a bottom wall, said cartridges being generally rectangular in shape, said keys also being generally rectangular in shape and adapted for sliding insertion into said cartridges.

30. The hand development system as defined by claim 29 including spring means coacting between said keys and cartridges to resist movement of said keys.

31. The hand development system as defined by claim 20 including a cap adapted to be disposed over said keys in cooperation with said body when said system is not in use.

* * * * *